US007383774B1

(12) United States Patent
Koehler et al.

(10) Patent No.: US 7,383,774 B1
(45) **Date of Patent: *Jun. 10, 2008**

(54) MICROELECTROMECHANICAL SAFING AND ARMING APPARATUS

(75) Inventors: David R. Koehler, Sherwood, OR (US); Darren A. Hoke, Albuquerque, NM (US); Louis S. Weichman, Albuquerque, NM (US); George E. Vernon, Rio Rancho, NM (US); Randy J. Shul, Albuquerque, NM (US); Michael H. Beggans, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 246 days.

This patent is subject to a terminal disclaimer.

(21) Appl. No.: 11/386,345

(22) Filed: Mar. 22, 2006

Related U.S. Application Data

(62) Division of application No. 10/641,980, filed on Aug. 14, 2003, now Pat. No. 7,051,656.

(51) Int. Cl.
*F42C 15/24* (2006.01)

(52) U.S. Cl. ..... 102/249; 102/231; 102/222; 102/226; 102/235

(58) Field of Classification Search ..... 102/249, 102/231, 222, 226, 229, 235
See application file for complete search history.

(56) References Cited

U.S. PATENT DOCUMENTS 4,986,184 A 1/1991 Kude
5,501,893 A 3/1996 Laermer et al.
5,693,906 A 12/1997 Van Sloun
5,705,767 A 1/1998 Robinson
5,990,427 A 11/1999 Lammert et al.
6,064,013 A 5/2000 Robinson
6,130,464 A 10/2000 Carr
6,167,809 B1 1/2001 Robinson et al.
6,173,650 B1 1/2001 Garvick et al.
6,199,874 B1 3/2001 Galvin et al.
6,314,887 B1 11/2001 Robinson
6,321,654 B1 11/2001 Robinson
6,401,621 B1 6/2002 Davis et al.
6,431,071 B1 8/2002 Hodge et al.
6,453,746 B1 9/2002 Polosky et al.
6,568,329 B1 5/2003 Robinson
6,586,691 B2 7/2003 Itoigawa et al.
6,622,629 B2 9/2003 Hodge et al.
6,737,979 B1 5/2004 Smith et al.
2003/0070571 A1 4/2003 Hodge et al.

*Primary Examiner*—Michelle Clement
(74) *Attorney, Agent, or Firm*—John P. Hohimer

(57) ABSTRACT

A two-stage acceleration sensing apparatus is disclosed which has applications for use in a fuze assembly for a projected munition. The apparatus, which can be formed by bulk micromachining or LIGA, can sense acceleration components along two orthogonal directions to enable movement of a shuttle from an "as-fabricated" position to a final position and locking of the shuttle in the final position. With the shuttle moved to the final position, the apparatus can perform one or more functions including completing an explosive train or an electrical switch closure, or allowing a light beam to be transmitted through the device.

10 Claims, 10 Drawing Sheets

MICROELECTROMECHANICAL SAFING AND ARMING APPARATUS

This is a division of application Ser. No. 10/641,980 filed Aug. 14, 2003 now U.S. Pat. No. 7,051,656, which is pending.

GOVERNMENT RIGHTS

This invention was made with Government support under Contract No. DE-AC04-94AL85000 awarded by the U.S. Department of Energy. The Government has certain rights in the invention.

CROSS REFERENCE TO RELATED APPLICATIONS

This application is related to application Ser. No. 10/641,8609 filed on Aug. 14, 2003 and entitled "Microelectromechanical Acceleration Sensing Latch".

FIELD OF THE INVENTION

The present invention relates in general to microelectromechanical (MEM) devices, and in particular to an apparatus for sensing acceleration along two orthogonal axes that has applications for the safing and arming of projected munitions.

BACKGROUND OF THE INVENTION

Safing and arming devices are generally provided in munitions as part of a fuze assembly to ensure that the munition is not armed and detonated until certain conditions have been met. For projected munitions, an environmental sensing device (ESD) can be provided to sense some phenomenon of the trajectory (e.g. an acceleration level or acceleration-time interval) of the projected munition prior to furnishing a switch closure or signal for arming the device prior to reaching an endpoint of the trajectory. Conventional safing and arming devices (see e.g. U.S. Pat. No. 5,693,906) are formed from a plurality of machined metal parts using hand assembly. The machining of many individual parts which must be made with close tolerances and then assembled by hand is relatively expensive and also results in a completed device which is relatively bulky. More recently, microelectromechanical systems (MEMS) and LIGA (an acronym for "Lithographic Galvanoforming Abforming" which is a process for fabricating millimeter-sized mechanical or electromechanical devices based on building up the structure of the LIGA devices by photolithographic definition using an x-ray or synchrotron source and metal plating or deposition) technology have been combined to fabricate relatively complicated safing and arming devices utilizing a zig-zag delay and which require a separate moveable slider for each acceleration being sensed (see e.g. U.S. Pat. Nos. 6,167,809; 6,314,887; and 6,568,329).

The present invention represents an advance over the prior art by providing a two-stage acceleration sensing apparatus that is considerably simpler in construction than prior art devices and which can be readily adapted to provide different types of safing and arming capabilities based on electrical, optical or explosive functionality, or a combination thereof.

The present invention also provides a uniform design architecture which can be readily adapted during design and manufacture to form safing and arming devices which are enabled by predetermined acceleration components which can range from less than a few Gs up to tens or hundreds of thousands of Gs depending upon a particular application of the apparatus.

The present invention further provides a safing and arming device which can be formed using conventional semiconductor integrated circuit (IC) technology, with a large number of devices being formed on a common wafer and then separated as a final step in manufacture. This can reduce manufacturing cost and eliminate the need for piece part assembly.

These and other advantages of the present invention will become evident to those skilled in the art.

SUMMARY OF THE INVENTION

The present invention relates to an apparatus for sensing acceleration along two orthogonal axes which comprises a substrate (e.g. comprising silicon); a shuttle formed within a well in the substrate and suspended on a plurality of springs for movement of the shuttle in the plane of the substrate; a first latch located on one side of the shuttle and attached to the substrate to lock the shuttle in a first position until the first latch is disengaged in response to a first acceleration component directed substantially normal to the substrate whereupon the shuttle is released for movement in response to a second acceleration component which is substantially in-plane with the substrate; and a second latch located on another side of the shuttle for locking the shuttle after an in-plane movement of the shuttle to a second position distal to the first position.

The first latch preferably comprises a cantilevered beam having a thickness less than the thickness of the shuttle and can further include a clasp located at a free end of the cantilevered beam for engaging with one or more tabs located on the shuttle to lock the shuttle in the first position until the shuttle is disengaged upon occurrence of the first acceleration component. The second latch can comprise one or more cantilevered beams, with each cantilevered beam having a catch formed at a free end thereof for engaging a tang projecting from the shuttle to hold the shuttle in the second position. A stop can be provided in the apparatus to prevent movement of the shuttle beyond the second position.

In certain embodiments of the present invention, both the shuttle and the second latch can be made electrically conductive to provide a completed current path for an electrical current when the shuttle is located in the second position (i.e. to perform a switch closure).

In other embodiments of the present invention, the shuttle can further comprise a window formed therethrough, with the window in the shuttle being misaligned with respect to an opening formed through a subbase attached to an underside of the substrate when the shuttle is in the first position, and aligned with the opening through the subbase when the shuttle is in the second position. In these embodiments of the present invention, the shuttle can provide for the transmission of light through the shuttle and subbase when the shuttle is in the second position and can block the transmission of light through the shuttle and subbase when the shuttle is in the first position. The transmission of light can be used to provide optical functionality for the two-stage acceleration sensing apparatus, or to form an optically-enabled safing and arming device.

Alternately, a primary explosive can be located within the window in the shuttle, and a secondary explosive can be located in the opening through the subbase. This arrangement can form an incomplete explosive train when the shuttle is in the first position wherein the ignition of the primary explosive will be incapable of igniting the secondary explosive which is displaced laterally from the primary explosive. When the shuttle is moved to the second position, a completed explosive train is formed whereby the ignition of the primary explosive will result in the ignition of the secondary explosive which is located proximate thereto.

A lid can also be provided over a top side of the substrate for encapsulation of the shuttle, with the lid in certain embodiments of the present invention having an opening therethrough which is aligned with the opening in the subbase and the window through the shuttle when the shuttle is in the second position. In other embodiments of the present invention, the lid can hold an initiator or detonator for igniting the primary explosive located within the window of the shuttle. The lid and subbase can be attached to the substrate by an adhesive or by fusion bonding (e.g. when the subbase and lid each comprise silicon).

The present invention further relates to an apparatus for sensing acceleration along two orthogonal axes which comprises a substrate (e.g. a silicon substrate); a shuttle formed within a well in the substrate, with the shuttle being suspended from a plurality of springs for movement in the plane of the substrate, and with the shuttle having a window formed therethrough; a first latch located on one side of the shuttle and attached to the substrate for locking the shuttle in a first position, with the window in the shuttle being misaligned with an opening through a subbase below the substrate until a first acceleration component substantially normal to the substrate is sensed by the apparatus whereupon the first latch is disengaged to enable the shuttle to move in response to a second acceleration component which is substantially in-plane with the substrate; and a second latch located on another side of the shuttle for locking the shuttle after an in-plane movement of the shuttle to a second position located away from the first position, with the window in the shuttle in the second position being aligned with the opening through the subbase.

The first latch can comprise a cantilevered beam with a clasp located at a free end thereof for engaging one or more tabs located on the shuttle. The second latch can comprise one or more catches for engaging a tang projecting from the shuttle to lock the shuttle in the second position. A stop can also be provided in the apparatus prevent an in-plane movement of the shuttle beyond the second position.

The shuttle and the second latch can be made electrically conductive to provide a completed current path for an electrical current when the shuttle is located in the second position. In some preferred embodiments of the present invention, a primary explosive can be located in the window in the shuttle, and a secondary explosive can be located in the opening through the subbase. In these embodiments of the present invention, the primary explosive upon ignition thereof will be blocked from igniting the secondary explosive when the shuttle is in the first position, and will be enabled to ignite the secondary explosive when the shuttle is in the second position.

A lid can be formed over the substrate and the shuttle, with the lid being attached to the substrate (e.g. by an adhesive or by fusion bonding which can also be used to attach the subbase to the substrate). The lid can include an initiator or detonator for igniting an explosive located within the window of the shuttle.

The present invention also relates to a two-stage acceleration sensing apparatus which comprises a substrate (e.g. a semiconductor substrate such as a silicon substrate), a shuttle formed, at least in part, from the substrate and suspended upon a plurality of springs for movement, with the shuttle being initially located at a first position (i.e. an "as-fabricated" position); a first latch formed from the substrate to lock the shuttle at the first position until the first latch is disengaged in response to a first acceleration component, thereby releasing the shuttle for movement; and a second latch formed, at least in part, from the substrate to capture the shuttle upon moving from the first position to a second position (i.e. a final position) in response to a second acceleration component which is directed substantially orthogonally to the first acceleration component. The first acceleration component is directed substantially perpendicular to the plane of the substrate; and the second acceleration component is directed substantially parallel to the plane of the substrate. Both the shuttle and second latch can be made electrically conductive to provide a completed current path for an electrical current when the shuttle is located in the second position.

The apparatus can further include a subbase attached to the substrate, with a window through the shuttle being aligned with an opening through the subbase when the shuttle is in the second position. The window can hold a primary explosive, and the opening in the subbase can hold a secondary explosive. A lid can be attached to the substrate opposite the subbase, with the lid holding an initiator or detonator for igniting the primary explosive when the shuttle is in the second position.

The present invention further relates to a microelectromechanical safing and arming apparatus that comprises a subbase having an opening therethrough for holding a first explosive; a shuttle attached to the substrate by a plurality of springs, with the shuttle holding a second explosive which is initially misaligned from the first explosive and locked in this "safe" position by a first latch. The first latch can be disengaged in response to an acceleration component directed substantially normal to the substrate. This allows movement of the shuttle to a second "armed" position in response to another acceleration component which is directed substantially in-plane with the subbase. In the second position, the first and second explosives are aligned to form an explosive train. A second latch is also provided in the apparatus for locking the shuttle in the second position. A lid can be provided over the substrate and shuttle, with the lid including an initiator or detonator for igniting the second explosive.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
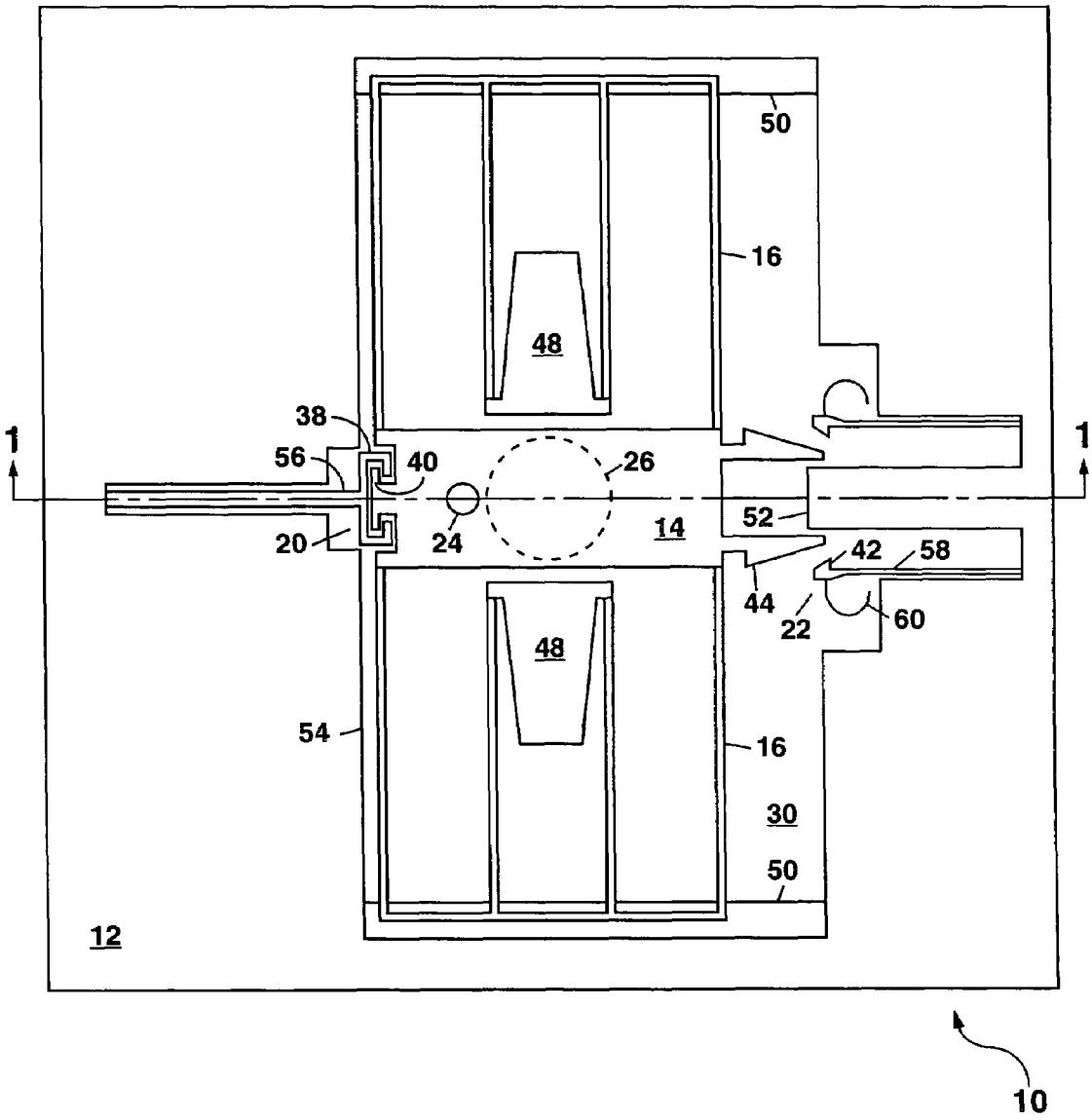
FIG. 1 shows a schematic plan view of a first example of the apparatus of the present invention in an as fabricated position and with a lid removed to show details of the shuttle and latches.

Referring to FIG. 1, there is shown a schematic plan view of a first example of the two-stage acceleration sensing apparatus 10 of the present invention which can be used as a safing and arming device in a fuze assembly for a projected munition. In FIG. 1, the apparatus 10 comprises a substrate 12, a shuttle 14 which can be formed, at least in part, from the substrate 12 and which is suspended for movement in the plane of the substrate 12 by a plurality of folded springs 16. A lid 18 which overlies the substrate 12 has been omitted from FIG. 1 for clarity, but is schematically illustrated in the cross-sectional view of FIG. 2A taken along the section line 1-1 in FIG. 1.

In FIG. 1, a first latch 20 is provided in the apparatus 10 to lock the shuttle 14 in an "as-fabricated" position (i.e. a first position) until the first latch 20 is disengaged by bending the first latch 20 downward in response to a first acceleration component (shown as $A_1$ in FIG. 2B) which is directed substantially perpendicular (i.e. normal) to the plane of the substrate 12. This momentarily releases the first latch 20 and frees the shuttle 14 to move in the plane of the substrate 12 in response to a second acceleration component (denoted as $A_2$ in FIG. 2C) which is generally directed at a right angle (i.e. orthogonally) to the first acceleration component so that the second acceleration component $A_2$ is substantially in-plane with the substrate 12. A second latch 22 is provided in the apparatus 10 to capture and lock the shuttle 14 in a second position (i.e. a final position) after movement of the shuttle 14 thereto in response to the second acceleration component $A_2$.

Figure 2A:
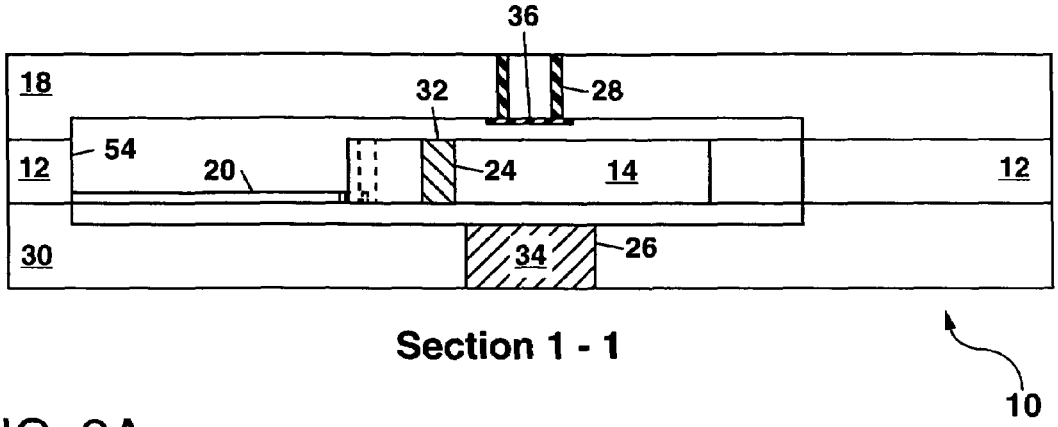
FIG. 2A shows a schematic cross-section view of the apparatus of FIG. 1 along the section line 1-1 in FIG. 1, with the apparatus being in an as-fabricated position with the shuttle being initially locked in place by the first latch.

In the example of FIG. 1, the two acceleration components $A_1$ and $A_2$ must occur in sequence with the two acceleration components $A_1$ and $A_2$ overlapping in time for successful operation of the device 10. If the second acceleration component $A_2$ occurs prior to the first acceleration component $A_1$ or after the first acceleration component $A_1$ has ceased or been reduced below a threshold value, the shuttle 14 will remain locked in the "as-fabricated" position as shown in FIGS. 1 and 2A. Additionally, each acceleration component $A_1$ and $A_2$ must exceed a certain predetermined threshold for successful operation of the device 10. The two acceleration components $A_1$ and $A_2$ thus form a unique signature which must be satisfied in order to unlock the apparatus 10 and to move it from a "safe" state to an "armed" state.

In FIG. 1, a window 24 is formed through the shuttle 14 and an opening 26 is formed through a subbase 30 below the substrate 12. The window 24, with the shuttle 14 in the "as-fabricated" position, is misaligned with respect to the opening 26 in the subbase 30. Upon sensing the two acceleration components $A_1$ and $A_2$ in the proper sequence and with the proper magnitudes and timing as described previously, the shuttle 14 can be urged from the first "as-fabricated" position to the second position and locked in place there so that the window 24 and opening 26 which were initially misaligned become aligned.

Figure 2B:
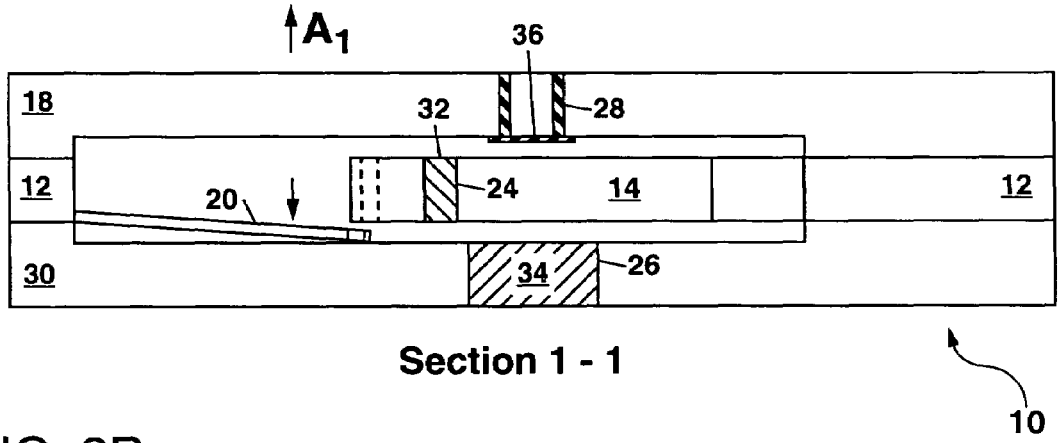
FIG. 2B shows a schematic cross-section view of the apparatus of FIG. 1 to illustrate disengagement of the first latch from the shuttle in response to an acceleration component $A_1$ that is directed substantially normal to the plane of the substrate.
Figure 2C:
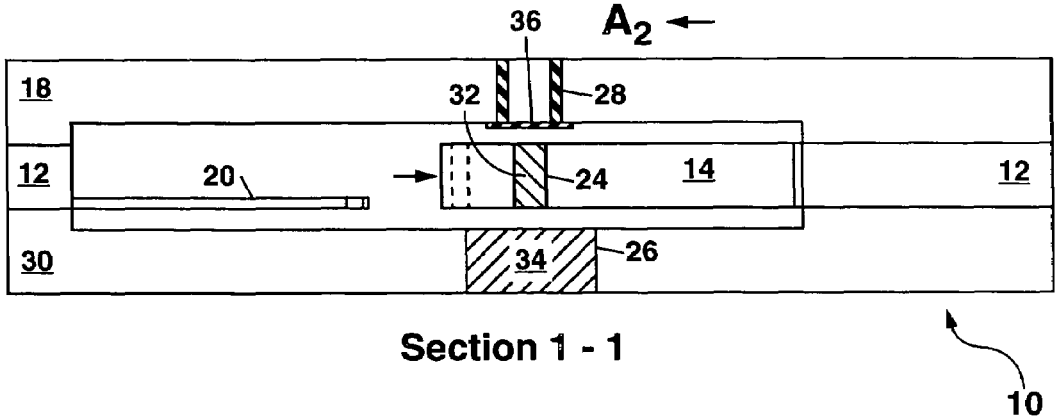
FIG. 2C shows a schematic cross-section view of the apparatus of FIG. 1 after movement of the shuttle to a second position in response to another acceleration component $A_2$ that is directed substantially in-plane with the substrate and after locking of the shuttle in the second position.

In using the apparatus 10 of FIG. 1 to form a safing and arming device for a fuze assembly in a projected munition, the window can hold a primary explosive 32, and a secondary explosive 34 can be provided in the opening 26 in the subbase 30 as shown in FIGS. 2A-2C. An explosive-initiator or detonator 36 can also be provided in the lid 18 in alignment with the secondary explosive 34. In the as-fabricated position shown in FIGS. 1 and 2A, a direct ignition path between the initiator or detonator 36 and the explosives 32 and 34 is blocked due to the misalignment of the primary explosive 32 located in the window 24 in the shuttle 14. In this state, an explosive train formed by the initiator or detonator 36 and the explosives 32 and 34 is incomplete so that arming of the munition is prevented with the result being that the fuze assembly for the munition is in a "safe" state.

Upon launch of the projected munition (e.g. firing from a gun), the apparatus 10, when used in a fuze assembly, will experience an acceleration component $A_1$ as shown in FIG. 2B which is directed substantially normally to the plane of the substrate 12 and which can be up to several tens of thousands of Gs, where G is the acceleration due to gravity. This acceleration component $A_1$ urges a free end of the cantilevered first latch 20 downward as shown in FIG. 2B thereby disengaging a clasp 38 located at the free end of the first latch 20 from one or more tabs 40 on the shuttle 14.

With the first latch 20 disengaged, the shuttle 14 is free to move in the plane of the substrate 12 suspended on the springs 16. Movement of the shuttle 14 can be effected by another acceleration component $A_2$ which is directed substantially in the plane of the substrate 12 as shown in FIG. 2C. The acceleration component $A_2$ can be, for example, a centripetal acceleration due to rotation of the projected munition by up to hundreds of revolutions per second, with the centripetal acceleration being given by:

$$A_c=\omega^2 r$$

where $\omega$ is an angular velocity of rotation of the projected munition containing the apparatus 10, and r is a radial distance from an axis of rotation of the projected munition to a center of mass point of the shuttle 14. For a centripetal acceleration, the acceleration component $A_2$ is directed to the left in FIG. 2C wherein the axis or rotation of the projected munition is preferably located and this results in a force (indicated by the rightward pointing arrow in FIG. 2C) on the mass of the shuttle 14 and in opposition to a restoring force provided by the springs 16 which, if substantial enough, can urge the shuttle 14 upon release from the first latch 20 to move to the right towards the second position where the shuttle 14 can be captured and locked in place by the second latch 22 (see also FIG. 3).

Figure 3:
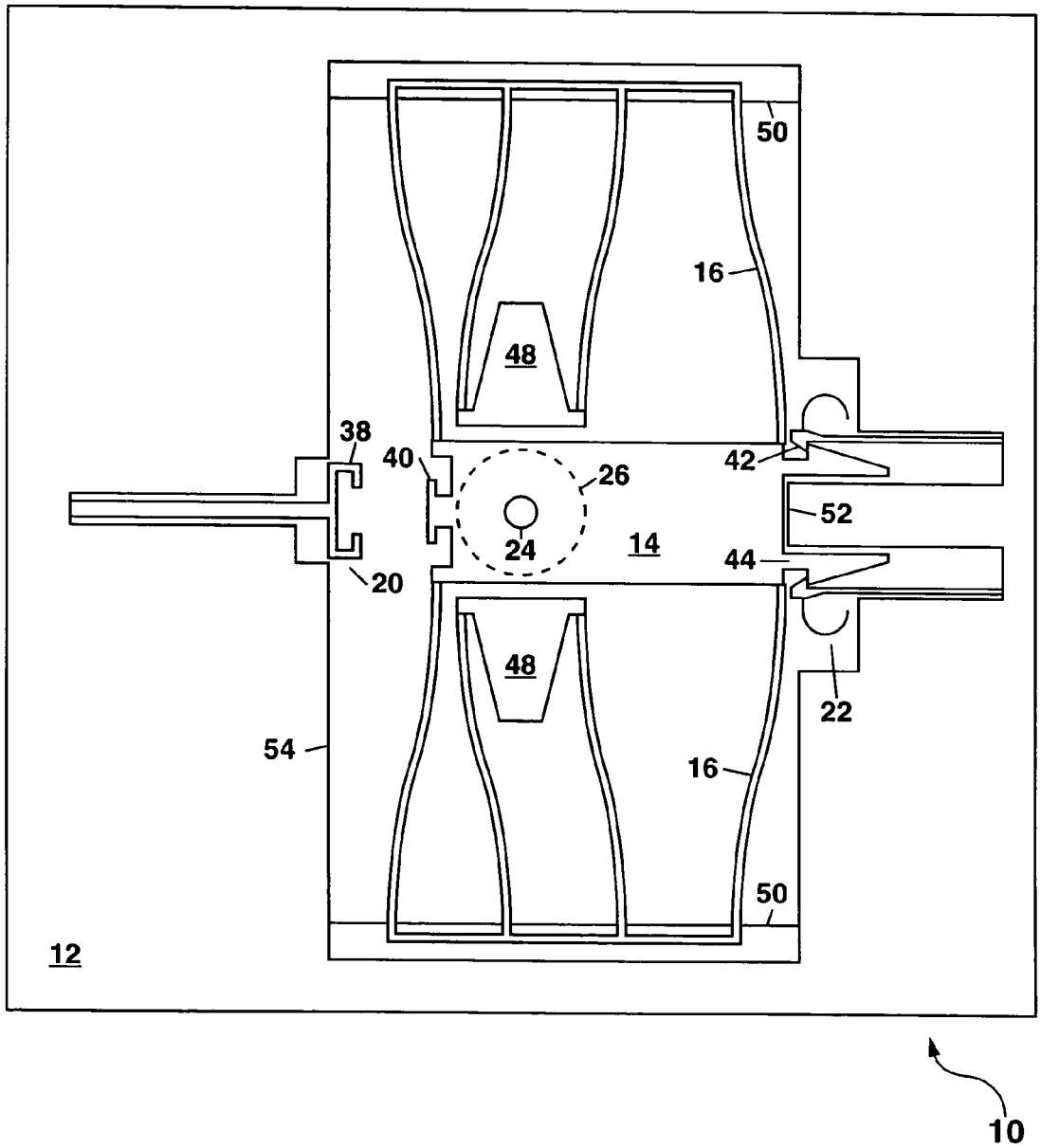
FIG. 3 shows a schematic plan view of the apparatus of FIG. 1 after movement of the shuttle to the second position as illustrated in the cross-section view of FIG. 2C.

When the acceleration component $A_2$ is in a preferred direction as indicated in FIG. 2C and exceeds a predetermined threshold value as determined by the mass of the shuttle 14 and the compliance of the springs 16 and one or more catches 42, the shuttle 14 can move past the catches 42 and be captured as shown in FIGS. 2C and 3. Each catch 42 engages with a tang 44 projecting outward from the shuttle 14 as shown in FIGS. 1 and 3 thereby locking the shuttle 14 in the second position (i.e. the "armed" state) with the explosives 32 and 34 and the initiator or detonator 36 being aligned to form a complete explosive train and to place the apparatus in the "armed" state. In the "armed" state, the complete explosive train shown in FIG. 2C allows the initiator or detonator 36 to ignite the primary explosive 32 which, in turn, ignites the secondary explosive 34 which can then ignite a much larger explosive charge (not shown) which is located adjacent to the subbase 30 in the projected munition.

Fabrication of the first example of the apparatus 10 of the present invention will now be described with reference to FIGS. 4A-4K which show a series of schematic cross-section views along the section line 1-1 in FIG. 1. The fabrication can be performed using a series of semiconductor process steps which include repeated steps for photolithographic mask definition and etching. Those skilled in the art will understand that although FIGS. 4A-4K describe the formation of a single device 10, which can have dimensions of a few millimeters on a side, in actuality a large number of devices 10 will be batch fabricated together and then separated for individual use.

Figure 4A:
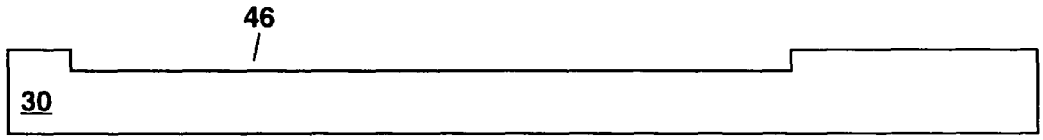
FIGS. 4A-4K show schematic cross-section views along the section line 1-1 in FIG. 1 to illustrate fabrication of the first example of the apparatus of FIG. 1.

In FIG. 4A, a subbase 30 can be formed by providing a semiconductor wafer (e.g. comprising silicon) which can be, for example, about 500 μm thick. A photolithographically patterned photoresist mask (not shown) can be formed over a top side of the semiconductor wafer and an exposed portion of the wafer etched to form a cavity 46 (see also FIGS. 1 and 3) which can be about 100 μm deep. An unetched portion of the subbase 30 within the cavity 46 can be masked during etching to begin to build up a base 48 for use in supporting the springs 16 (see FIG. 1).

The etching can be performed using a deep reactive ion etch (DRIE) process such as that disclosed in U.S. Pat. No. 5,501,893 to Laermer, which is incorporated herein by reference. The DRIE process utilizes an iterative Inductively Coupled Plasma (ICP) deposition and etch cycle wherein a polymer etch inhibitor is conformally deposited as a film over the semiconductor wafer during a deposition cycle and subsequently removed during an etching cycle. The polymer film, which is formed in a $C_4F_8$/Ar-based plasma, deposits conformally over the photolithographically patterned photoresist mask, over any exposed portions of the semiconductor wafer, and over sidewalls of the cavity 46 being etched. During a subsequent etch cycle using an $SF_6$/Ar-based plasma, the polymer film is preferentially sputtered from the cavity 46 or other features being etched in the semiconductor wafer and from the top of the photoresist mask. This exposes unmasked portions of the semiconductor wafer to reactive fluorine atoms from the $SF_6$/Ar-based plasma with the fluorine atoms being responsible for etching the exposed portions of the semiconductor wafer. After the polymer at the bottom of the cavity 46 has been sputtered away and the bottom etched by the reactive fluorine atoms, but before the polymer on the sidewalls of the cavity 46 has been completely removed, the polymer deposition step using the $C_4F_8$/Ar-based plasma is repeated. This cycle continues until a desired etch depth is reached. Each polymer deposition and etch cycle generally lasts only for a few seconds (e.g. ≦10 seconds). The net result is that features can be anisotropically etched into the semiconductor wafer or completely through the semiconductor wafer while maintaining substantially straight sidewalls (i.e. with little or no inward tapering).

In forming the cavity 46, a shelf 50 (see FIG. 1) can be formed on each side of the cavity 46 to limit vertical movement of the springs 16 in response to the acceleration component $A_1$. In this case, two DRIE etch steps with separate photolithographically patterned photoresist masks can be performed so that the shelf can be etched to a depth of 10 μm below a top surface of the semiconductor wafer. This can be done, for example, by providing the two photoresist masks over the semiconductor wafer and initially etching down to a depth of 90 μm. One of the photoresist masks, which was protecting an area of the wafer reserved for each shelf 50 from being etched during a first DRIE etch step, can then be removed and a second DRIE etch step performed to etch the cavity 30 including the shelves 50 downward another 10 μm.

Figure 4B:
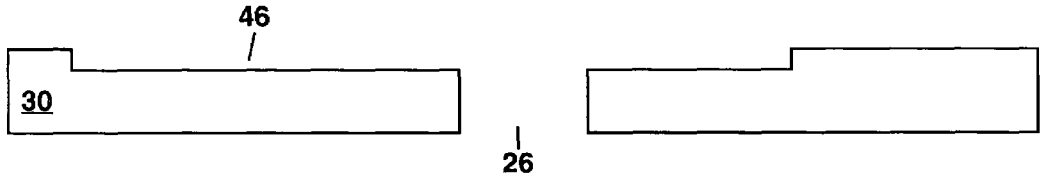

Once etching of the semiconductor wafer from the top side thereof is complete, a photolithographically patterned photoresist mask can be provided on a bottom side of the semiconductor wafer, and another DRIE etch step can be performed from the bottom side completely through the semiconductor wafer to form the opening 26 in the subbase 30 as shown in FIG. 4B. After each DRIE etching step, the photoresist mask can be removed and the wafer cleaned, as needed, to remove any photoresist residue. A thermal oxide layer about 1 μm thick can then be formed on the semiconductor wafer at an elevated temperature (e.g. 1050° C.).

Figure 4C:
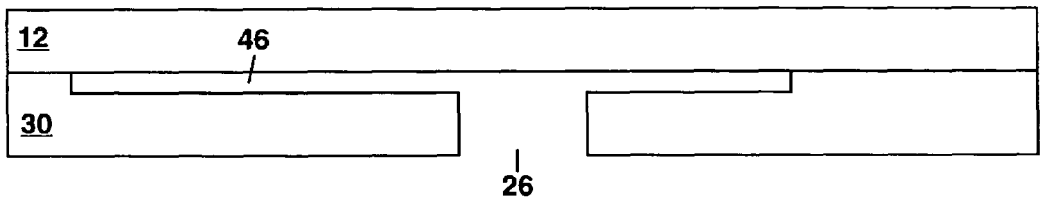

In FIG. 4C, a second semiconductor wafer (i.e. substrate 12) can be prepared for fusion bonding by forming a 1-μm-thick thermal oxide layer on each side thereof as described above. Fusion bonding (also termed wafer bonding or diffusion bonding) can then be used to permanently attach the substrate 12 to the subbase 30. The fusion bonding can be performed at an elevated temperature of 1050° C. in an oxygen ambient for one hour with the surfaces of the substrate 12 and the subbase 30 being brought into intimate contact with each other. After the substrate 12 has been fusion bonded to the subbase 30, the substrate 12 can be lapped and polished down to a thickness of, for example, 100 μm.

When an electrically-conductive layer (e.g. the electrically-conductive layer 68 described hereinafter with reference to FIGS. 6 and 7) is to be provided on the substrate 12, the electrically-conductive layer can be deposited and patterned on the substrate 12 prior to etching of the substrate 12, with the electrically-conductive layer being protected from etching by an overlying photolithographically-patterned photoresist layer. The electrically-conductive layer is electrically isolated from the substrate 12 by the thermal oxide layer.

A two-step DRIE etch process can be utilized to form the various elements in the substrate 12 including the shuttle 14, the springs 16, the first latch 20 and the second latch 22. Additionally, this two-step DRIE etch process builds up the base 48 for supporting the springs 16 and also forms the window 24 through the shuttle 14 and a stop 52 (see FIGS. 1 and 3) which prevents the shuttle 14 from moving beyond the second position wherein it is captured by the second latch 22. The window 24 can have a diameter of generally up to a few hundred microns (μm).

Figure 4D:
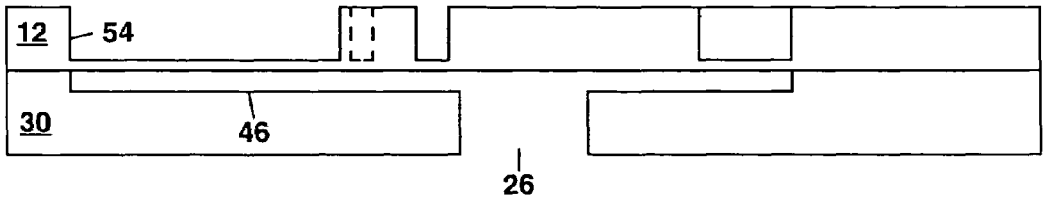
Figure 4E:
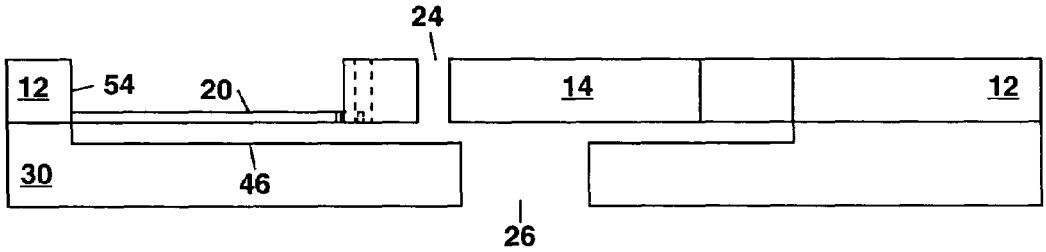

In a first step of the two-step DRIE etch process, the substrate 12 can be etched downward through a majority of the thickness of the substrate 12 as shown in FIG. 4D to begin to form a well 54 wherein the various elements being formed from the substrate 12 will be located and to define the shapes of the various elements including the shuttle 14, springs 16 and second latch 22, and also a portion of the support 48 being formed from the substrate 12. A second step of the two-step DRIE etch process can then be used to complete formation of the shuttle 14, springs 16, second latch 22 and support 48 as shown in FIG. 4E, and also to fabricate the first latch 20 which has a thickness much smaller than the thickness of the substrate 12 and shuttle 14. As an example, the first latch 20 can have a thickness of about 25 μm as compared to the thickness of the substrate 12 and shuttle 14 which can be 100 μm. The exact thickness of the first latch 20 will generally depend upon the magnitude of the first acceleration component $A_1$.

The first latch 20 comprises a cantilevered beam 56 with a clasp 38 located at a free end of the beam 56 as shown in FIG. 1. The beam 56 generally has a thickness which is less than its width so that the beam 56 is responsive to the first acceleration component $A_1$ which is directed substantially perpendicular to the substrate 12 and is much less responsive to any acceleration component which is directed in the plane of the substrate 12. Additionally, the beam 56 can be constrained by the surrounding substrate 12 as shown in FIG. 1 to limit movement of the beam 56 in the plane of the substrate 12 in response to an in-plane acceleration component.

The second latch 22 can be formed with a pair of cantilevered beams 58 with a catch 42 formed at a free end of each beam 58. The width of each beam 58 is much smaller than the thickness thereof so that the beams 58 are act as springs and move in the plane of the substrate 12 as each tang 44 is urged past a corresponding catch 42 when the shuttle 14 moves in response to the second acceleration component $A_2$. The catches 42 then lock the shuttle 14 in place at the second position as shown in FIG. 3. An optional hook 60 shown in FIGS. 1 and 3 can be provided at the free end of each cantilevered beam 58 for use in manually releasing the catch 42 to unlock the shuttle 14 and return it to the "as-fabricated" position. This also requires that the first latch 20 be manually depressed. The optional hooks 60 can be formed from the substrate material during fabrication of the second latch 22 with the hooks 60 having a thickness equal to that of the beams 58 and shuttle 14. The hooks 60, which are not needed for operation of the apparatus 10, are nevertheless useful during repeated testing of the apparatus 10 to ensure proper operation in response to the acceleration components $A_1$ and $A_2$.

The springs 16 are preferably formed with a folded and interconnected construction as shown in FIG. 1 with one end of each interconnected spring 16 being attached to a support 48, and with the other end of each interconnected spring 16 being attached to the shuttle 14. This arrangement of the springs 16 takes up less space than if the springs 16 were unfolded, and it also allows the springs 16 on each side of the shuttle 14 to act in unison. The thickness of the springs 16 is generally the same as that of the shuttle 14 (e.g. 100 μm), with the width of each spring 16 generally being in the range of 2-10 μm and with the exact width being defined by the magnitude of the second acceleration force $A_2$ and other factors including the mass of the shuttle 14. An overall length of each spring 16 can be up to several millimeters. Excessive vertical movement of the springs 16 during the time when the acceleration component $A_1$ is applied can be limited by underlying shelves 50 which can be optionally formed in the subbase 30 (see FIG. 1) and in an overlying lid 18.

Figure 4F:
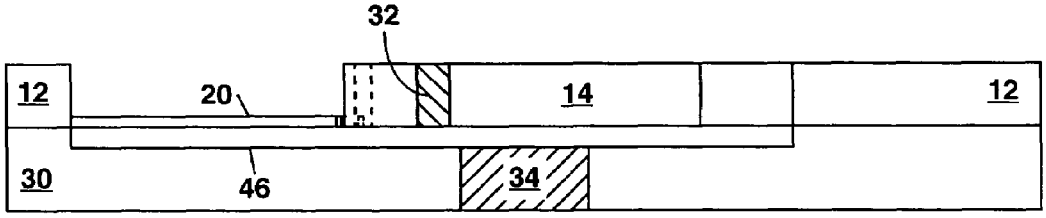

In FIG. 4F, once the features in the substrate 12 have been defined, the primary explosive 32 can be loaded into the window 24 in the shuttle 14; and the secondary explosive 34 can be loaded into the opening 26 through the subbase 30. The primary explosive 32 can comprise a primary explosive material (e.g. lead azide, silver azide or lead styphanate) which can be dispensed into the window 24 as a liquid or paste and allowed to solidify. Surface tension can hold the primary explosive material in the window 24 until solidification occurs. The secondary explosive 34 can comprise a cyclic or polycyclic nitramine explosive which can be loaded into the opening 26 in the subbase 30.

Figure 4G:
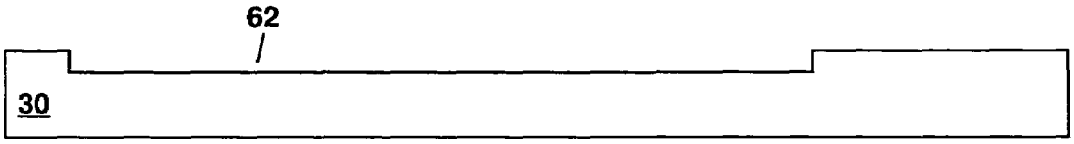

In FIG. 4G, a lid 18 can be formed from yet another semiconductor wafer (e.g. comprising silicon) in a manner similar to fabrication of the subbase 30 as previously described with reference to FIGS. 4A and 4B. A photolithographically patterned photoresist mask (not shown) can be provided over a top side of the semiconductor wafer exposing a portion of the wafer wherein a recess 62 is to be formed. The recess 62, which can be 100 μm deep, is then etched into the semiconductor wafer as shown in FIG. 4G using a DRIE etch step. The recess 62 can have the shape of the cavity 46 etched into the subbase 30, and can optionally include one or more shelves 50 as previously described for limiting vertical movement of the springs 16.

Figure 4H:
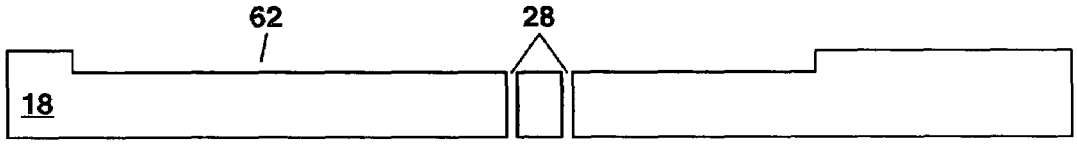
Figure 4I:
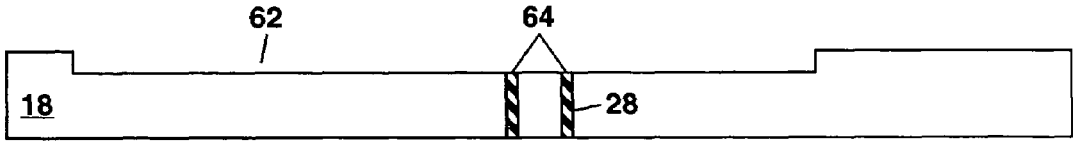

In FIG. 4H, a second DRIE step can be performed to etch a pair of vias 28 completely through the semiconductor wafer wherefrom the lid 18 is being fabricated. The second DRIE step can be performed after providing a photolithographically patterned photoresist mask on a bottom side of the semiconductor wafer so that the etching proceeds inward from the bottom side. A thermal oxide layer can be formed over the semiconductor wafer as previously described with a thickness of, for example, 1 μm. A metal (e.g. gold, aluminum or tungsten) can then be deposited in the vias 28 as shown in FIG. 4I to form electrical connections 64 through the lid 18 for use in electrically igniting the initiator or detonator 36 which can then be deposited in the recess 62. Electrical wiring and contact pads (not shown) can also be deposited and patterned on a surface of the lid 18 opposite the recess 62 either during or after formation of the electrical connections 64. The electrical wiring and contact pads enable the attachment of electrical wires to the device 10 to provide an electrical current for firing the initiator or detonator 36. The electrical current can be provided by a fuze assembly, and in some embodiments of the present invention the electrical current be enabled by a switch closure in the apparatus 10 which occurs when the shuttle 14 is in the second position (see FIGS. 6 and 7).

Figure 4J:
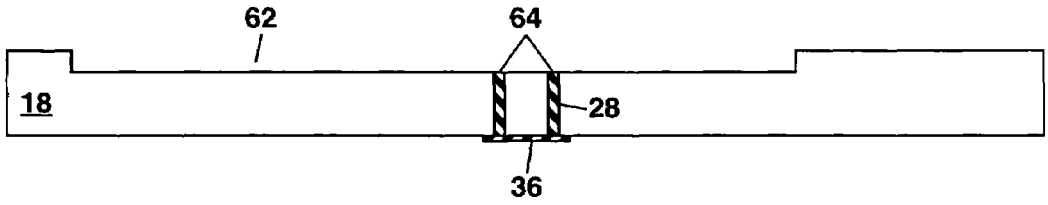

In FIG. 4J, the initiator or detonator 36 can be deposited as one or more layers in the recess 62 and over the electrical connections 64. The initiator or detonator 36 can comprise, for example, an electrically-initiated reactive bridge as known to the art which produces a burst of sparks in response to an applied electrical current passed therethrough, or any other type of explosive initiator or detonator as known to the art. The reactive bridge initiator or detonator 36, which can be used to ignite the primary explosive 32, can comprise a plurality of alternating layers of two different atomic elements (e.g. titanium and boron, or aluminum and palladium) which undergo a vigorous exothermic reaction upon melting and intermixing in response to the applied electrical current.

Figure 4K:
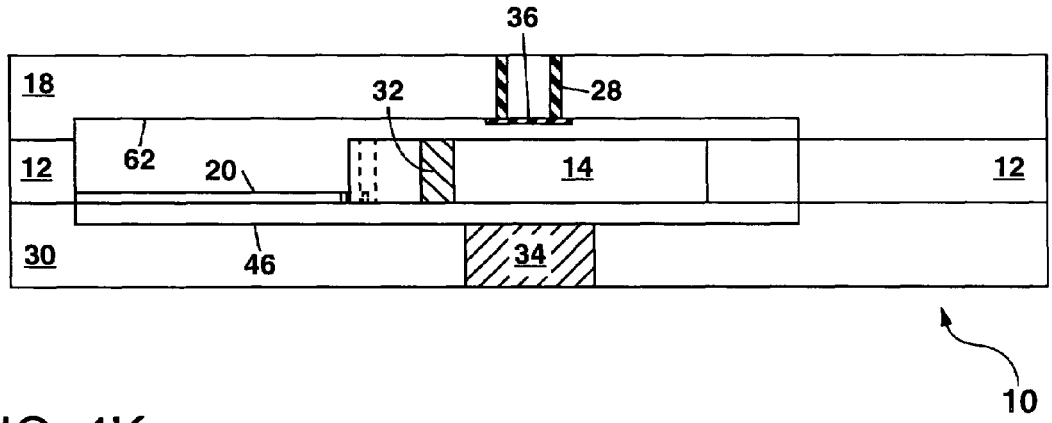

In FIG. 4K, the lid 18 has been inverted and attached to the substrate 12 to complete the formation of the device 10. This attachment can be performed, for example, using an adhesive (e.g. an epoxy). In other embodiments of the present invention, the lid 18 can be attached by fusion bonding in a manner similar to the fusion bonding of the subbase 30 to the substrate 12 as previously described with reference to FIG. 4C.

Figure 5A:
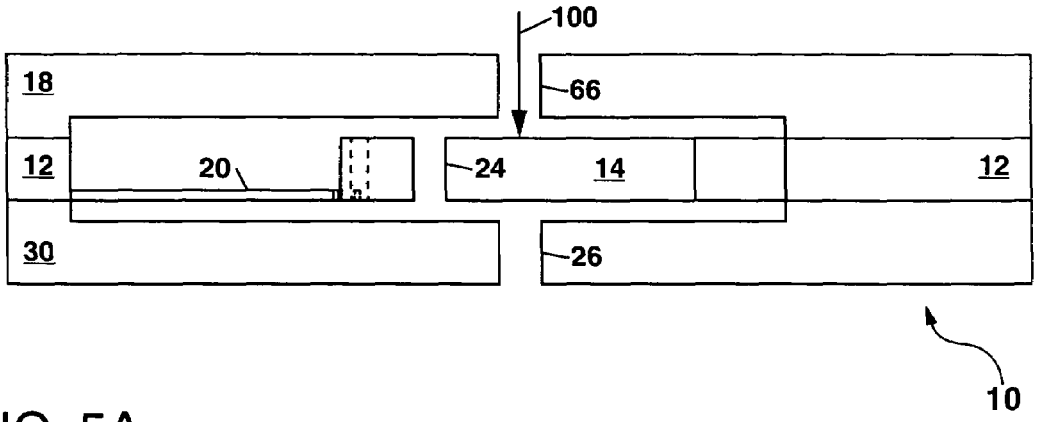
FIGS. 5A-5C show schematic cross-section views of a second example of the apparatus of the present invention.
Figure 5B:
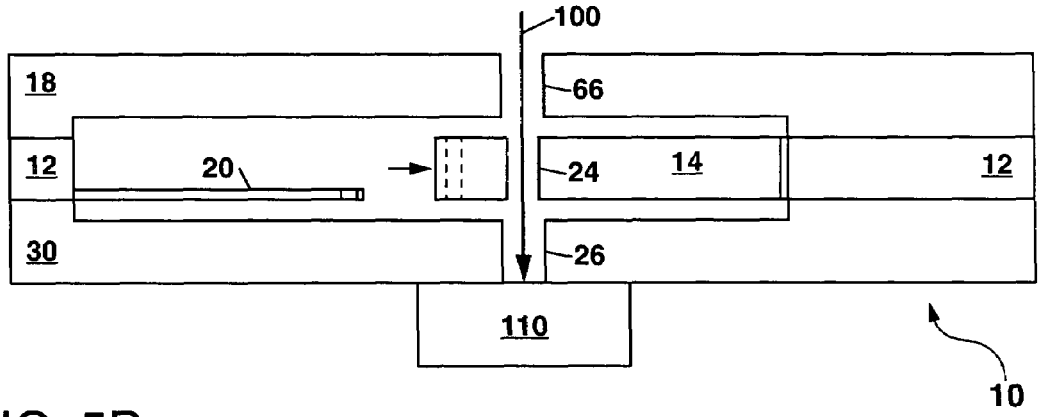
Figure 5C:
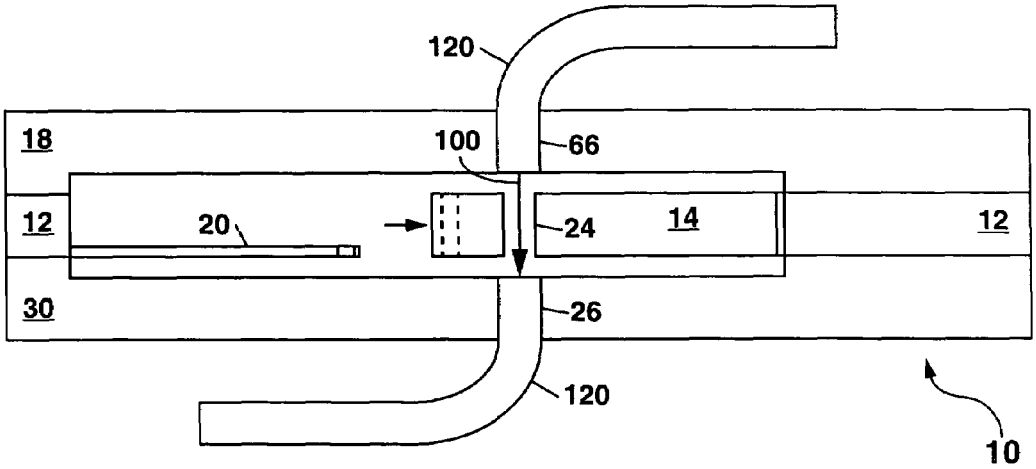

A second example of the apparatus 10 of the present invention is shown schematically in the cross-section views of FIGS. 5A-5C. These cross-section views are taken along a section line that passes through the center of the shuttle 14 and first latch 20 corresponding to the section line 1-1 in FIG. 1. The second example of the apparatus 10 can have a structure for the latches 20 and 22 and the shuttle 14 similar to that shown in FIGS. 1 and 3. Additionally, the second example of the apparatus 10 in FIGS. 5A-5C has an opening 66 in the lid 18 which is aligned with the opening 26 in the subbase 30. This second example of the apparatus 10 has applications for use as a two-stage acceleration sensor 10 which can be optically addressed and read out. No explosive components are utilized in the two-stage acceleration sensor 10 of FIGS. 5A-5C which has application, for example, as a part of a fuze assembly for a projected munition with any explosives being located apart from the apparatus 10 of FIGS. 5A-5C.

In FIG. 5A, a beam of light 100 can be directed into the apparatus 10 through the opening 66 in the lid 18, or alternately through the opening 26 in the subbase 30. The beam of light 100 is blocked from being transmitted through the apparatus 10 by the shuttle 14 in the "as-fabricated" position. For transmission of the light beam 100 through the apparatus 10, the two orthogonal acceleration components $A_1$ and $A_2$ must be experienced by the apparatus 10 in order to move the shuttle 14 to the second position as shown in FIG. 5B. In the second position, the shuttle 14 is locked in place by the second latch 22 with the window 24 in the shuttle 14 aligned with the openings 66 and 26 in the lid 18 and the subbase 30, respectively, thereby allowing the light beam 100 to be transmitted through the apparatus 10. After transmission through the apparatus 10, the light beam 100 can be detected to indicate that the two acceleration components $A_1$ and $A_2$ have in fact been experienced by the apparatus 10.

The light beam 100 can be provided by any source of light including an incandescent source, a light-emitting diode (LED) or a laser (e.g. a vertical-cavity surface-emitting laser). A photodetector 110 can be attached to the apparatus 10 as shown in FIG. 5B, or alternately the photodetector 110 can be located proximate to the apparatus 10 and optically coupled thereto. In some embodiments of the apparatus 10, one or more optical fibers 120 can be provided to conduct the light beam 100 into and out of the apparatus 10 as shown in FIG. 5C.

The second example of the apparatus 10 can be fabricated in a manner similar to that previously described with reference to FIGS. 4A-4K except that the steps used to load the explosives 32 and 34 and to form the electrical conductor 28 and the initiator or detonator 36 can be omitted and instead the opening 66 can be formed in place of the vias 28. Additionally, since no explosive components are utilized in the second example of the apparatus 10, the lid 18 can be fusion bonded to the substrate 12 at high temperature, or alternately attached with an adhesive. If the second example of the apparatus 10 is to be utilized with optical fibers 120, the optical fibers 120 can be attached to the lid 18 and/or subbase 30 using an adhesive (e.g. an epoxy adhesive).

Figure 6:
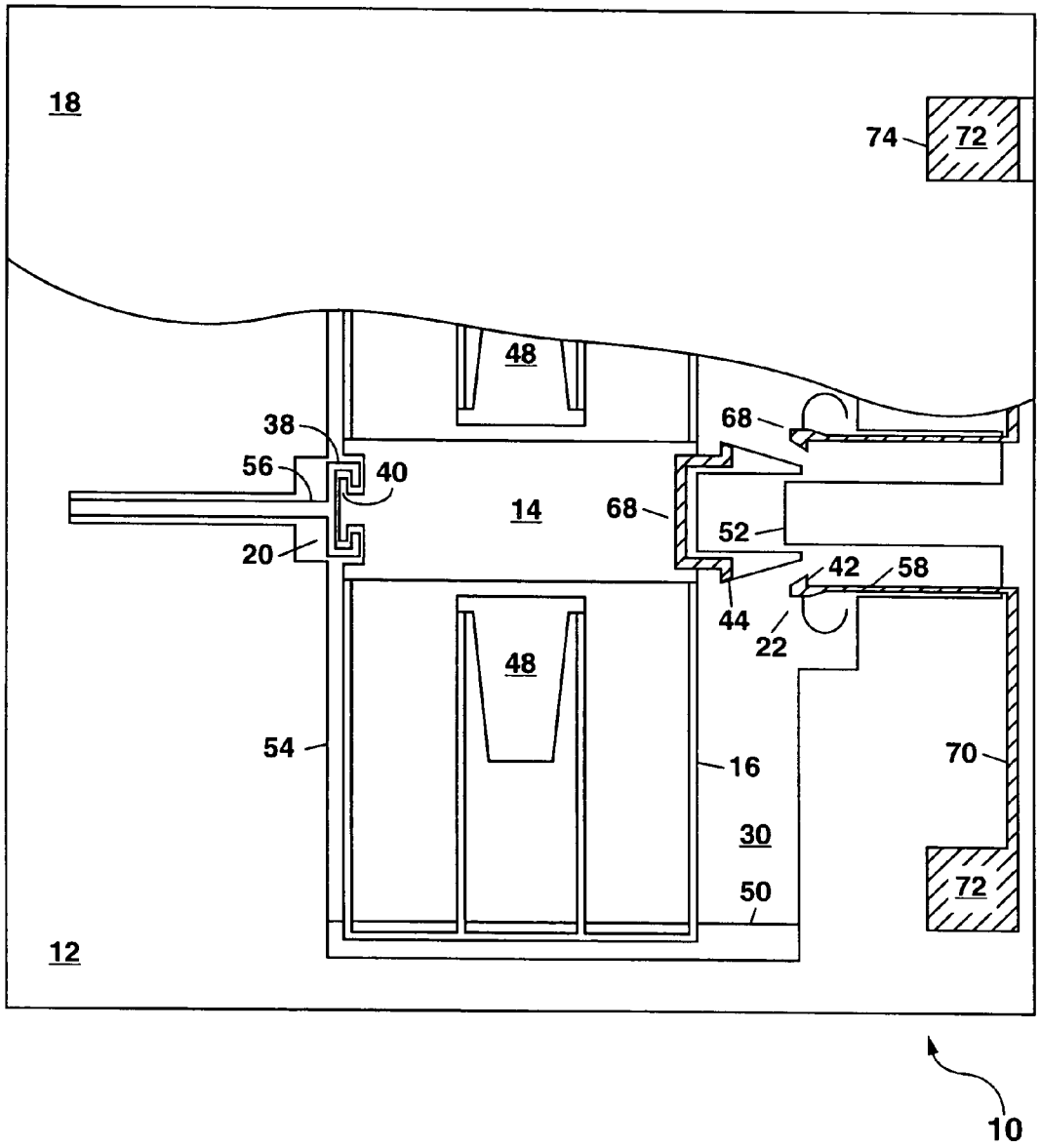
FIG. 6 shows a schematic plan view of a third example of the apparatus of the present invention in an "as-fabricated" condition, with the apparatus providing an electrically "open" state due to an incomplete electrical circuit formed by the shuttle and second latch.
Figure 7:
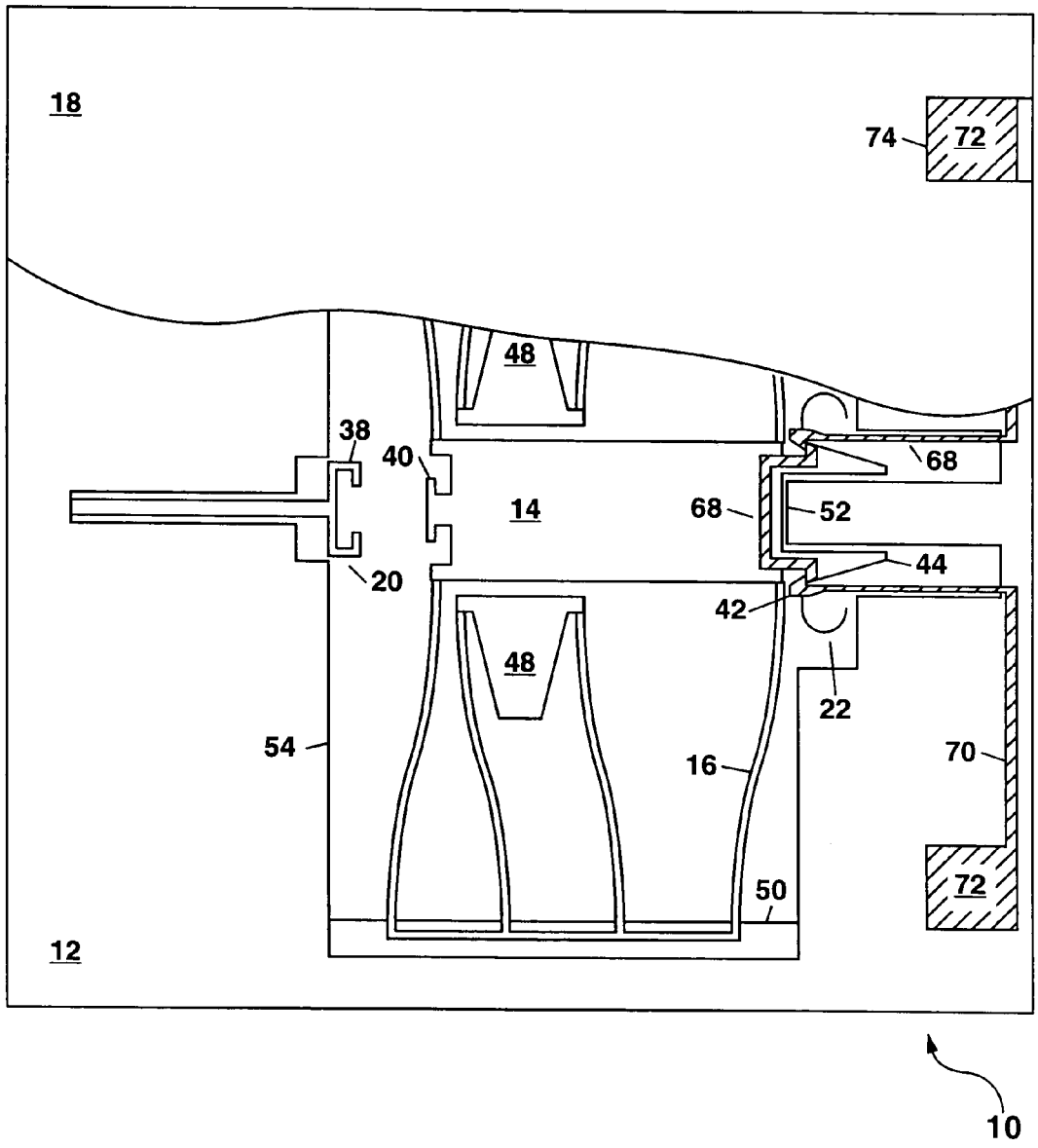
FIG. 7 shows a schematic plan view of the apparatus of FIG. 6 after experiencing orthogonal acceleration components $A_1$ and $A_2$ of the proper magnitude, duration and timing sequence as required to move the shuttle to a final position wherein an electrically "closed" state results with a completed electrical circuit being formed by contact of the shuttle with the second latch.

FIGS. 6 and 7 schematically illustrate in plan view a third example of the apparatus 10 of the present invention. In the third example of the present invention, a two-stage acceleration sensing apparatus 10 is provided which can be electrically read out to determine whether the acceleration components $A_1$ and $A_2$ have occurred. Thus, the third example of the present invention essentially functions as an electrical switch or latch which remains in an "open" (i.e. electrically non-conductive) state so long as the two orthogonally-directed acceleration components $A_1$ and $A_2$ have not occurred in the proper sequence and with the proper magnitudes and timing, and which then switches to a "closed" (i.e. electrically conductive) state upon the occurrence of the two orthogonally-directed acceleration components $A_1$ and $A_2$ and remains latched in the "closed" state thereafter. The third example of the apparatus 10 of the present invention can also be used as a part of a fuze assembly for a projected munition. In some embodiments of the present invention, the third example of the apparatus 10 can be combined with the first example to provide both electrical switching and explosive train enabling functions for a fuze assembly for a projected munition.

In FIG. 6, an electrically-conductive layer 68 can be disposed at least partially over the shuttle 14 and/or the tangs 44 protruding outward therefrom and also over portions of the second latch 22 including the cantilevered beams 58 and catches 42 to make these elements of the apparatus 10 electrically conductive. The electrically-conductive layer 68 can also be used to form wiring 70 and contact pads 72 on the substrate 12. The electrically-conductive layer 68, which can comprise a layer of a metal (e.g. gold, aluminum, nickel, copper or tungsten) or a doped semiconductor material (e.g. polycrystalline silicon doped with boron or phosphorous during chemical vapor deposition), can be deposited over an electrically-insulating layer (e.g. the oxide layer described previously or alternately a layer of an electrically-insulating material such as silicon nitride, silicon dioxide or a silicate glass) which may be required when the substrate 12 is not electrically insulating (e.g. when the substrate is not an undoped or semi-insulating semiconductor substrate). The electrically-conductive layer 68 can be, for example, 0.5-3 μm thick and can be deposited by chemical vapor deposition when the layer 68 comprises a semiconductor material such as polycrystalline silicon (also termed polysilicon), or alternately by a metal deposition process such as evaporation, sputtering or electroplating.

Fabrication of the third example of the apparatus 10 can proceed as described previously with reference to FIGS. 4A-4K. The electrically-conductive layer 68 can be deposited and patterned after the substrate 12 has been fusion bonded to the subbase 30 as shown in FIG. 4C but prior to DRIE etching of the substrate 12 as described with reference to FIG. 4D. After the layer 68 has been deposited and patterned by etching (e.g. reactive ion etching) or lift-off, the layer 68 can be protected during subsequent DRIE etching steps by the photoresist mask.

When the layer 68 comprises a metal, the layer 68 can alternatively be deposited after fabrication of the shuttle 14 and second latch 22 as previously described with reference to FIG. 4E. In this case, a shadow mask can be used so that the metal is deposited only on surfaces of the shuttle 14 and the second latch 22. The use of a shadow mask and tilting of the substrate 12 for deposition at different angles (e.g. ±45°) can be advantageous to allow the metal to also be deposited on vertically-oriented sidewall surfaces of each clasp 42 and tang 44.

The third example of the apparatus 10 of the present invention is shown in FIGS. 6 and 7 without any window through the shuttle 14 or any opening through the subbase 30. These elements can be omitted when the apparatus 10 of FIGS. 6 and 7 is to be used without any explosive components or light beams. In other embodiments of the present invention when the electrical switching functionality of the apparatus 10 of FIGS. 6 and 7 is to be used in combination with explosive components or with a light beam, then a window 24 can be provided in the shuttle 14 and an opening 26 can be provided in the subbase 30, with these elements being formed as previously described with reference to FIGS. 4D-4F.

Openings 74 in the lid 18 can be formed down to the contact pads 72 as shown in FIG. 6 to provide for the attachment of external wires to the apparatus 10. These openings 74 can be formed with using the DRIE etch steps previously described with reference to FIGS. 4D and 4E. Alternately, vias 28 can be formed through the lid 18 to provide electrical connections to the contact pads 72 or wiring 70 and metallized as previously described with reference to FIGS. 4H and 4I.

FIG. 6 illustrates the third example of the apparatus 10 in an "as-fabricated" condition which corresponds to an electrically "open" state since no electrical current can flow between the contact pads 72 due to the shuttle 14 not being in contact with the second latch 22 as required to complete an electrical connection between the contact pads 72. In FIG. 7, the apparatus 10 is shown after occurrence of the acceleration components $A_1$ and $A_2$ which result in disengagement of the shuttle 14 from the first latch 20 and movement of the shuttle 14 from its initial "as-fabricated" position to a final position wherein the shuttle 14 is captured and locked in place by the second latch 22. In this "closed" state, a completed electrical connection is made between the contact pads 72 through the electrically-conductive layer 68 disposed on the second latch 22 and shuttle 14 thereby allowing an electrical current to flow between the contact pads 72.

In other embodiments of the present invention, the features of the apparatus 10 of FIGS. 5A-5C can be combined with that of FIGS. 1 and 3 to provide a device 10 which provides an optical signal (i.e. transmission of a light beam 100) when the shuttle 14 is in the second position, and which further includes the explosives 32 and 34 and the initiator or detonator 36 which form a completed explosive train when the shuttle 14 is in the second position. This can be done, for example, by providing a pair of spaced-apart windows 24 in the shuttle 14 and a pair of spaced-apart openings 26 in the subbase 30, with an opening 66 in the lid 18 located above one of the openings 26 in the subbase 30 and with the electrical connections 64 and initiator or detonator 36 being located above the other opening 26 in the subbase 30. Then, when the shuttle 14 is in the second position, each window 24 will be aligned with a corresponding opening 26 so that a light beam 100 can be transmitted through the apparatus 10, and the explosive train therein will be completed.

Other applications and variations of the present invention will become evident to those skilled in the art. Although, the various examples of the apparatus 10 of the present invention have been described as being fabricated by micromachining of semiconductor wafers, those skilled in the art will understand that other types of materials including metals and insulators can be used to fabricate other embodiments of the apparatus 10. Additionally, those skilled in the art will understand that certain embodiments of the apparatus 10 of the present invention can be fabricated using LIGA wherein the various elements of the apparatus 10 including the first and second latches 20 and 22 and the shuttle 14 and springs 16 are built up from an electroplated metal (e.g. nickel or copper).

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A microelectromechanical safing and arming apparatus, comprising:

(a) a subbase having an opening therethrough for holding a first explosive;

(b) a shuttle suspended from a plurality of springs above the subbase, with the shuttle holding a second explosive initially misaligned from the first explosive;

(c) a first latch for locking the shuttle in a first position wherein the second explosive is misaligned with respect to the first explosive, with the first latch being disengageable to move in a direction substantially normal to a plane of the subbase in response to a first acceleration component directed substantially normal to the plane of the subbase to allow movement of the shuttle in an orthogonal direction substantially in-plane with the subbase to a second position wherein the first and second explosives are aligned in response to a second acceleration component directed substantially in-plane with the subbase; and (d) a second latch for locking the shuttle in the second position.

2. The apparatus of claim 1 further comprising a lid formed over the shuttle and subbase, with the lid including an initiator or detonator for igniting the second explosive when the shuttle is in the second position.

3. The apparatus of claim 1 wherein the first latch comprises a cantilevered beam having a thickness less than the thickness of the shuttle.

4. The apparatus of claim 3 wherein the first latch further comprises a clasp located at a free end of the cantilevered beam.

5. The apparatus of claim 4 wherein the shuttle comprises at least one tab for engaging the clasp to lock the shuttle in the first position.

6. The apparatus of claim 1 wherein the second latch comprises at least one cantilevered beam having a catch formed at a free end thereof for engaging a tang projecting from the shuttle to hold the shuttle in the second position.

7. The apparatus of claim 1 further comprising a stop to prevent an in-plane movement of the shuttle beyond the second position.

8. The apparatus of claim 1 wherein the subbase comprises silicon.

9. The apparatus of claim 1 wherein the first explosive comprises an explosive material selected from the group consisting of cyclic nitramine and polycyclic nitramine.

10. The apparatus of claim 1 wherein the second explosive comprises an explosive material selected from the group consisting of lead azide, silver azide and lead styphanate.

* * * * *